US008978329B2

(12) United States Patent
Edkins et al.

(10) Patent No.: US 8,978,329 B2
(45) Date of Patent: Mar. 17, 2015

(54) HANGER SYSTEM FOR CONCRETE BUILDING UNITS

(75) Inventors: David John Edkins, Auckland (NZ); Stuart Grant Ashby, Christchurch (NZ)

(73) Assignee: Stahlton Engineered Concrete, Ranau, Auckland (NZ)

( * ) Notice: Subject to any disclaimer, the term of this patent is extended or adjusted under 35 U.S.C. 154(b) by 229 days.

(21) Appl. No.: 13/120,830

(22) PCT Filed: Sep. 24, 2009

(86) PCT No.: PCT/NZ2009/000200

§ 371 (c)(1), (2), (4) Date: Sep. 20, 2012

(87) PCT Pub. No.: WO2010/036129

PCT Pub. Date: Apr. 1, 2010

(65) Prior Publication Data

US 2013/0074438 A1 Mar. 28, 2013

(30) Foreign Application Priority Data

Sep. 24, 2008 (NZ) ..... 571533

(51) Int. Cl.

| | |
|---|---|
| ***E04B 1/20*** | (2006.01) |
| ***E04B 5/16*** | (2006.01) |
| ***E04B 5/18*** | (2006.01) |
| ***E04B 1/41*** | (2006.01) |
| ***E04B 1/21*** | (2006.01) |
| ***E04B 5/02*** | (2006.01) |

(52) U.S. Cl.

CPC . *E04B 1/41* (2013.01); *E04B 1/215* (2013.01); *E04B 5/023* (2013.01)

USPC ..... 52/319; 52/289; 52/702; 52/588.1

(58) Field of Classification Search

USPC ..... 52/289, 702, 713, 126.5, 319, 321, 326, 52/506.08, 588.1, 36.6

See application file for complete search history.

(56) References Cited

U.S. PATENT DOCUMENTS

| | | | | |
|---|---|---|---|---|
| 5,050,364 | A | 9/1991 | Johnson et al. | |
| 6,009,675 | A * | 1/2000 | Waalkes et al. | 52/239 |
| 6,079,173 | A * | 6/2000 | Waalkes et al. | 52/239 |
| 6,301,855 | B1 * | 10/2001 | Aerni | 52/702 |
| 6,494,639 | B1 * | 12/2002 | Friend | 403/403 |
| 6,520,357 | B1 * | 2/2003 | Kautz et al. | 211/191 |
| 8,166,717 | B2 * | 5/2012 | Kim | 52/326 |
| 8,209,925 | B2 * | 7/2012 | Foley | 52/289 |
| 2003/0024205 | A1 * | 2/2003 | Strickland | 52/702 |
| 2008/0172976 | A1 * | 7/2008 | Carney et al. | 52/702 |
| 2009/0100796 | A1 * | 4/2009 | Denn et al. | 52/849 |

* cited by examiner

*Primary Examiner* — Brian Glessner
*Assistant Examiner* — Brian D Mattei
(74) *Attorney, Agent, or Firm* — Greer, Burns & Crain, Ltd.

(57) ABSTRACT

A hanger for a cementitious building unit including: a first hanger component having: a body; and at least one first interlocking portion arranged in (a) predetermined position(s) on the body of the first hanger component a second hanger component including: a body; at least two second interlocking portions arranged in (a) predetermined position(s) on the body of the second hanger component; and an overhanging portion adapted to abut a building support surface wherein the first interlocking portions and second interlocking portions are complimentary to each other and provide for vertical height adjustment of the first hanger component in relation to the second hanger component; and the first hanger component also has at least one first connecting portion for a tension tie for anchorage within the cementitious building unit.

8 Claims, 10 Drawing Sheets

8A

8B

8C

8D

9A

9B

9C

9D

10A

10B

10C

10D

HANGER SYSTEM FOR CONCRETE BUILDING UNITS

BACKGROUND

The present invention relates to a hanger system for cementitious building units. In particular the present invention relates to an adjustable hanger system for precast cementitious building units.

The present invention is based on the provisional specification filed in relation to New Zealand Patent Application No. 571533 the entire contents of which are incorporated herein.

Precast concrete flooring units have been in use for a number of years and have become particularly prevalent in the construction of multi-story buildings.

These precast concrete flooring units typically are in the form of a "double tee" whereby bottom surfaces of the overhanging tee in the form of a web are supported on building support beams. More recently, in an effort to improve the performance of the flooring unit, the webs have been replaced with "dapped ends" (halved and reinforced ends) or flange supports (where a flexural tension reinforcement is added to the web) in an effort to reduce serviceability issues relating to the movement of the supports after installation by reducing the depth of the tee and bringing the support level closer to the centre of gravity.

Referring to FIG. 1, traditionally, hangers for double tee or rib-and-infill concrete flooring units have included a steel rebar (a) cast into a concrete slab (b), with an exposed section of the rebar welded to a heavy steel billet or box section (c) to provide a cantilever overhang for attachment of the concrete flooring unit to a structural beam or column. This method of construction is referred to as the "Cazaly method".

Disadvantages of this type of hanger are that they are heavy, making installation of the concrete flooring unit difficult. The unit itself is also expensive to manufacture, and requires welding of the rebar to the cantilever billet.

Referring to FIG. 2, attempts to overcome these disadvantages include the use of a more lightweight loop-bar or pigtail (d) which has its elongate 'leg' (e) cast into the concrete slab (f) and the loop (g) exposed to provide anchorage for a concrete top overhang portion (h) that supports the concrete flooring unit.

Disadvantages of this system include:

- lack of durability and relative lack of resistance to frame elongation and rotation of the support beams as a result of seismic activity; or
- shortening of the precast units due to creep, shrinkage, temperature change and/or repeated loading. Under estimation of the performance of the pigtail system can have severe safety consequences to the stability of the resulting building structure. The pigtail system was reviewed by the Structural Engineering Society of New Zealand (SESOC) who issued a warning document on 12 Jan. 2009 recommending that pigtail hangers are not used in New Zealand and at present they are not considered compliant for hanging double tee concrete floors. In addition, hollow core building elements are usually placed on top of a building support surface rather than hung below the support surface which can result in a relatively unstable structure if the support surface is moved (e.g. as a result of seismic activity) due to the higher centre of gravity.

A further significant disadvantage of both the rebar and pigtail concrete hangers is their lack of adjustment for use with flooring units of different thicknesses. This necessitates a manufacturer of such concrete building units to stock different sized hangers which can result in increased costs. In addition, the "pigtail hanger" is relatively expensive to manufacture.

It is an object of the present invention to provide a hanger system for concrete building units which address the foregoing problems or at least to provide the public with a useful choice.

It is acknowledged that the term 'comprising' may, under varying jurisdictions, be attributed with either an exclusive or an inclusive meaning. For the purpose of this specification, and unless otherwise noted, the term 'comprising' shall have an inclusive meaning—i.e. that it will be taken to mean an inclusion of not only the listed components it directly references, but also other non-specified components or units. This rationale will also be used when the term 'comprised' or 'comprising' is used in relation to one or more steps in a method or process.

SUMMARY

According to one aspect of the present invention there is provided a hanger for a cementitious building unit comprising:

- a first hanger component comprising:
  - a body; and
  - at least one first interlocking portion arranged in (a) predetermined position(s) on the body of the first hanger component
- a second hanger component comprising:
  - a body; and
  - at least two second interlocking portions arranged in predetermined positions on the body of the second hanger component;

wherein the first interlocking portion(s) and second interlocking portions are complimentary to each other and provide for vertical height adjustment of the first hanger component in relation to the second hanger component.

For the purposes of the specification the word "cementitious" refers to a composite material typically consisting of aggregate (gravel and sand), a binder (such as cement), and water but may also include other composite materials such as mortar based composites reinforced with polymer fibers (i.e. Engineered Cementitious Composite or ECC).

Preferably, the first hanger component also comprises at least one first connecting portion for a tension tie for anchorage within the cementitious building unit.

Preferably, the second hanger component also comprises at least one first connecting portion for a tension tie for increased anchorage within the cementitious building unit.

Preferably, the first hanger component and/or second hanger component also comprises at least one second connecting portion for a tension tie for anchorage within a post-cast topping cementitious portion.

More preferably, the at least second connecting portion for a tension tie is positioned proximal to an overhanging portion of the cementitious building unit adapted to abut a building support surface. In this way cracking of a post-cast topping cementitious portion is minimised and the strength of the connection between the hanger and the building support surface is maximised.

Preferably, the first interlocking portion(s) are (a) projection(s).

More preferably, the second interlocking portions are corresponding recesses.

Preferably, the first hanger component and/or second hanger component also comprises at least one aperture adapted to function as a lifting eye and an attachment point for the second tension tie.

Preferably, the building unit is a cementitious flooring unit.

More preferably, the cementitious flooring unit is a double-tee flooring unit, rib-and-infill flooring unit or a hollowcore flooring unit.

Preferably, the predetermined distance increments of the first and second interlocking portions provide for vertical height adjustment of the first hanger component in relation to the second hanger component of between 100 and 600 mm.

Preferably, the first hanger component and second hanger component are made from galvanised steel.

According to another aspect of the present invention there is provided a method of production of a cementitious building unit, said method comprising the steps:

a. interlocking at least one first interlocking portion arranged on a first hanger component with at least one second interlocking portion arranged on a second hanger component;
b. attaching at least one tension tie to the first hanger component and/or the second hanger component; and
c. casting the interlocked hanger system in a cementitious building unit.

Preferably, step c of the method of production of a cementitious building unit also comprises casting the interlocked hanger system in a cementitious building unit so that a lifting eye on the first or second hanger components is exposed.

According to another aspect of the present invention there is provided a method of construction using a cementitious building unit, said method comprising the steps:

a. interlocking at least one first interlocking portion arranged on a first hanger component with at least one second interlocking portion arranged on a second hanger component;
b. attaching at least one tension tie to the first hanger component and/or the second hanger component;
c. casting the interlocked hanger system in a cementitious building unit; and
d. positioning the pre-cast cementitious building unit in relation to a building structural support.

Preferably, step c of the method of construction using a cementitious building unit also comprises casting the interlocked hanger system in a cementitious building unit so that a lifting eye on the first or second hanger components is exposed.

More preferably, step d of the method of construction using a cementitious building unit also comprises positioning the pre-cast cementitious building unit in relation to a building structural support via the at least one lifting eye on the first or second hanger component.

Preferably, the method of construction using a cementitious building unit also comprises the step:

e. attaching at least one second tension tie to the cast-in first and/or second hanger component for anchorage to a building support surface.

BRIEF DESCRIPTION OF DRAWINGS

Further aspects of the present invention will become apparent from the ensuing description which is given by way of example only and with reference to the accompanying FIGS. 1 to 10 in which.

DETAILED DESCRIPTION

The invention is now described in relation to one preferred embodiment of the present invention with reference to FIGS. 3 to 10D.

Figure 1:
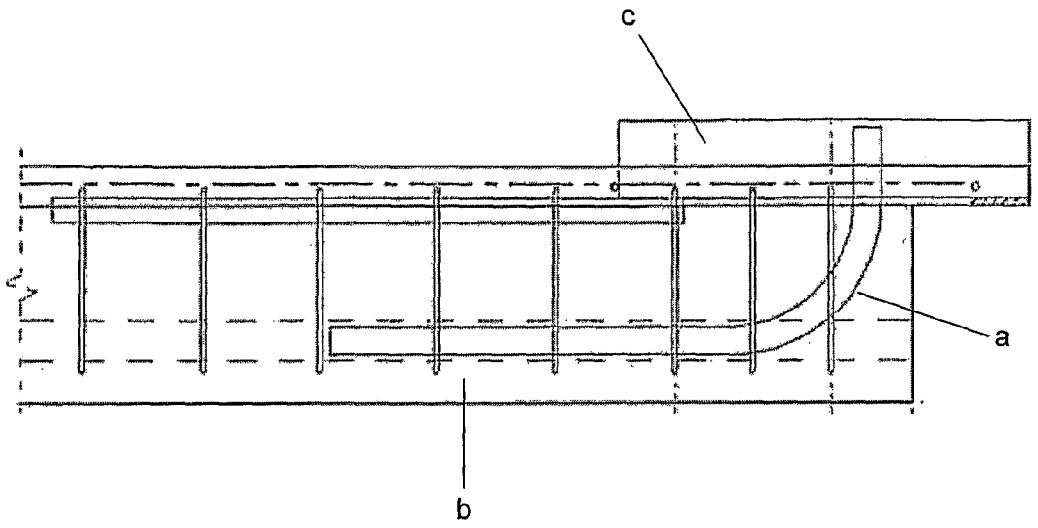
PRIOR ART FIGURE 1
FIG. 1 shows a cross-section of a prior art 'Cazaly method' hanger for cementitious building units usually in the form of double tee concrete flooring units.
Figure 2:
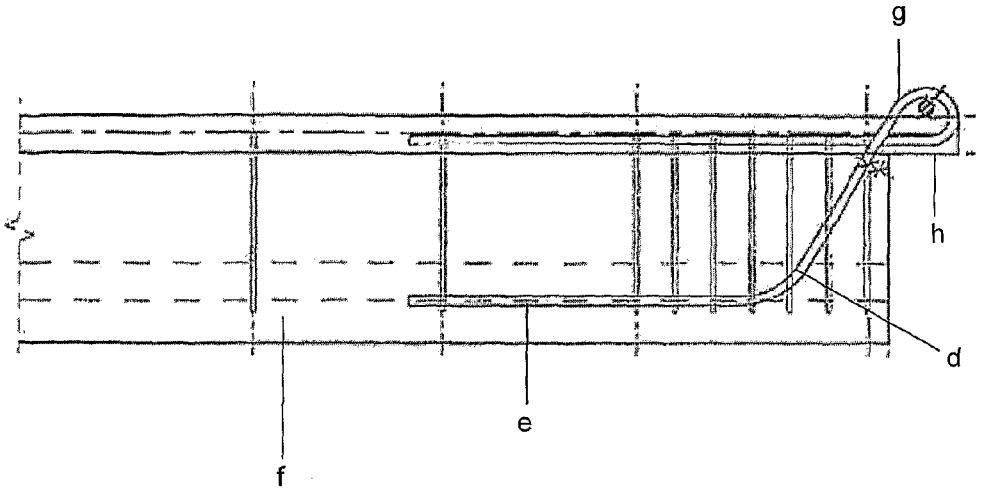
PRIOR ART FIGURE 2
FIG. 2 shows a cross-section of a prior art loop bar or pigtail system hanger for cementitious building units.
Figure 3:
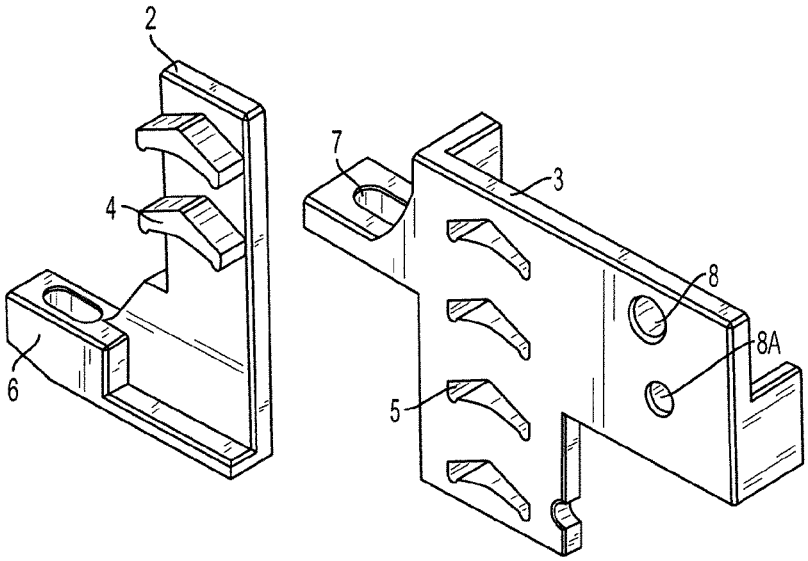
FIG. 3 shows a schematic view of a preferred embodiment of the present invention in the form of a hanger for concrete elements.

Referring to FIG. 3, a hanger system for cementitious building units such as concrete flooring units comprises a first hanger component 2 and a second hanger component 3. The first hanger component 2 has two first interlocking portions 4 in the form of chevron shaped protrusions arranged at predetermined positions on the body of the first hanger component 2. The second hanger component 3 has four second interlocking portions 5 in the form of four correspondingly shaped chevron shaped apertures arranged at predetermined positions on the body of the second hanger component 3. As can be seen apertures 5 are of complimentary shape to protrusions 4 so as to receive them in a close fit arrangement and thus interlock components 2 and 3. In this way, the first and second interlocking portions (4,5) enable interlocking of the first and second hanger components (2,3) at multiple positions in relation to one another to provide for adjustment of the vertical height of the first 2 and second 3 interlocked hanger components from 100 to 600 mm (depending on the height increments of the first and second interlocking portions (4,5)). It will be appreciated by those skilled in the art that different shapes of the first interlocking portion 4 and second interlocking portion 5, or juxtaposition of the projections of the first interlocking portion with the recesses of the second interlocking portion, may be used without departing from the scope of the present invention.

The first hanger component 2 has a seat 6 at its lower end for receiving a tension tie for a cast concrete flooring unit. The second hanger component 3 has a seat 7 at its upper end for receiving a tension tie for a cast concrete flooring unit. Aperture 8 is for receiving an additional (optional) reinforcing (or trimmer) bar. In addition the second hanger component 3 has one lifting eye for engagement by a lifting and/or placing tool (such as a hook of a crane) in the form of aperture 8A. The first and second hanger components are made of galvanised steel for durability and corrosion protection. The tension ties are made from recycled off-cuts of steel which provides for some measure of sustainability.

Figure 4:
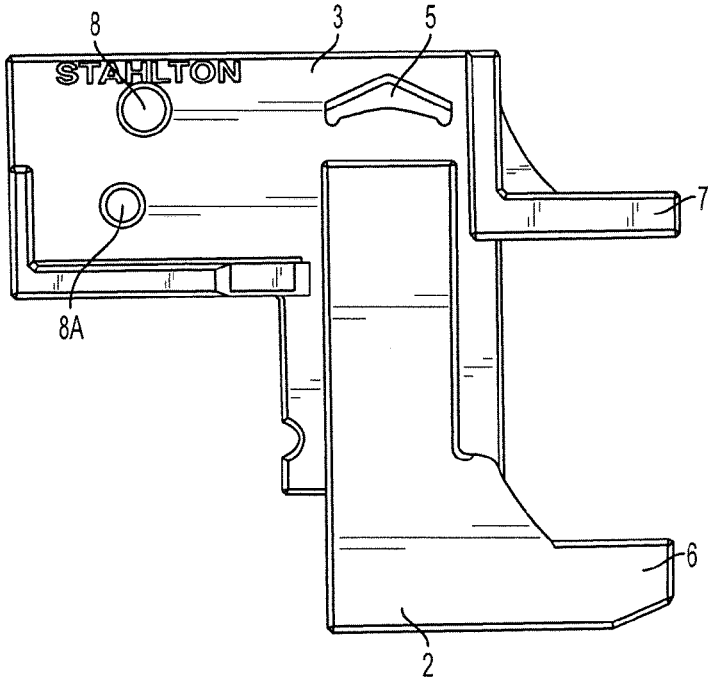
FIG. 4 shows a first side view of the preferred embodiment of the present invention shown in FIG. 3 with the first and second components interlocked.
Figure 5:
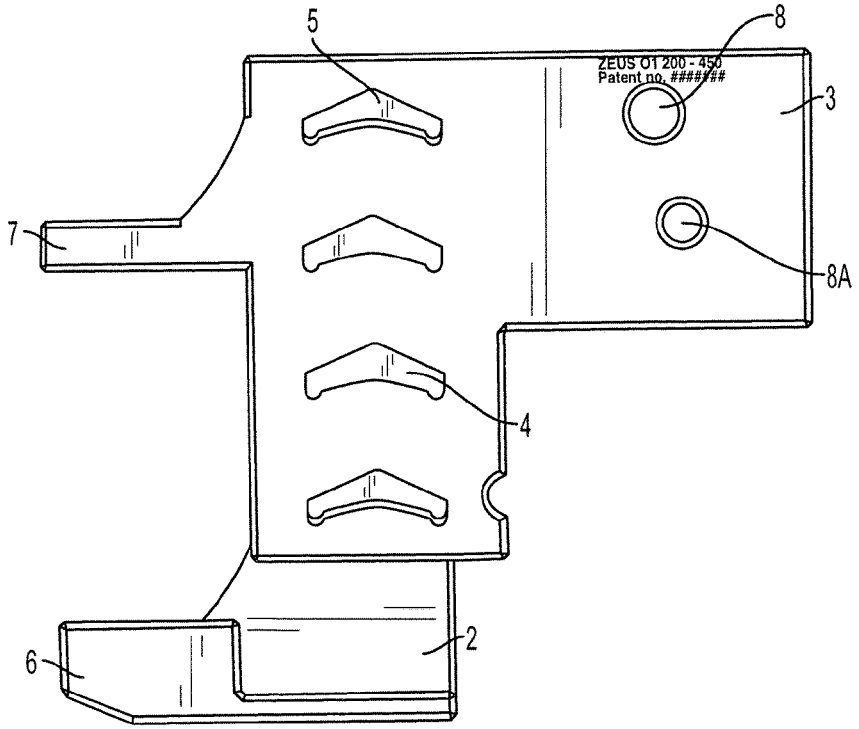
FIG. 5 shows a second side view of the preferred embodiment shown of the present invention in FIG. 3 with the first and second components interlocked.

FIGS. 4 and 5 show side views of the first hanger component 2 and a second hanger component 3 interlocked together via the first and second interlocking portions respectively (4,5).

Figure 6:
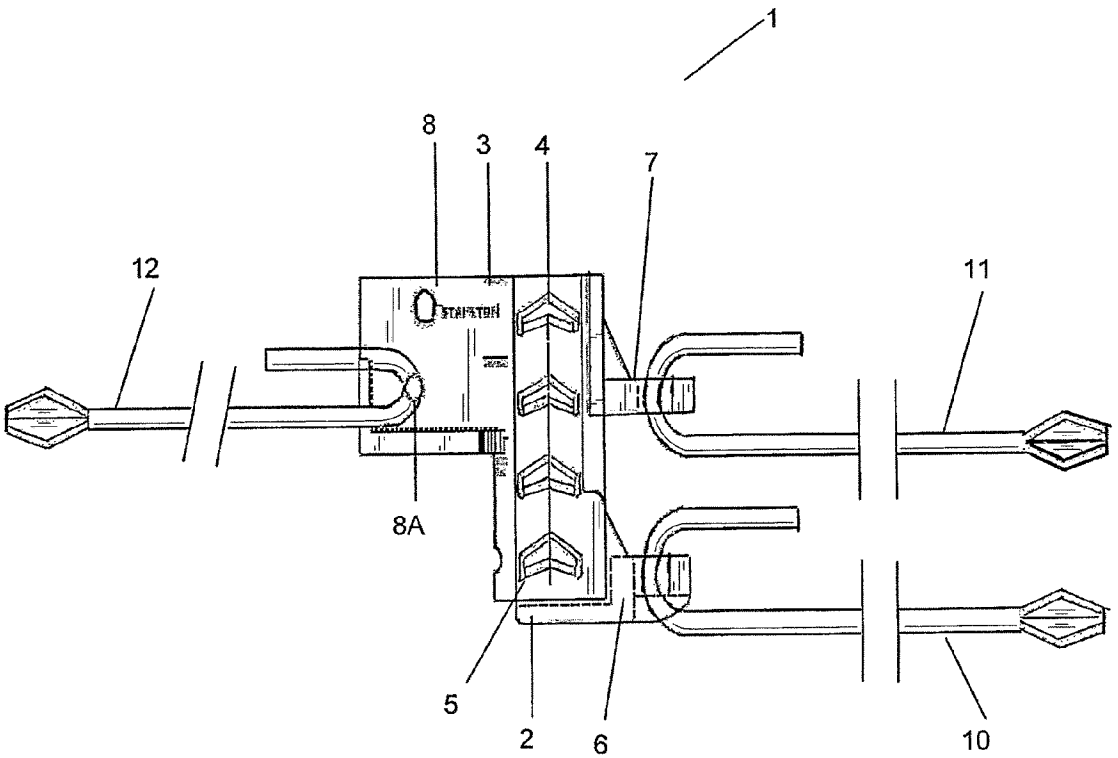
FIG. 6 shows a side view of the preferred embodiment of the present invention shown in FIGS. 3 and 4 with tension ties attached.
Figure 7:
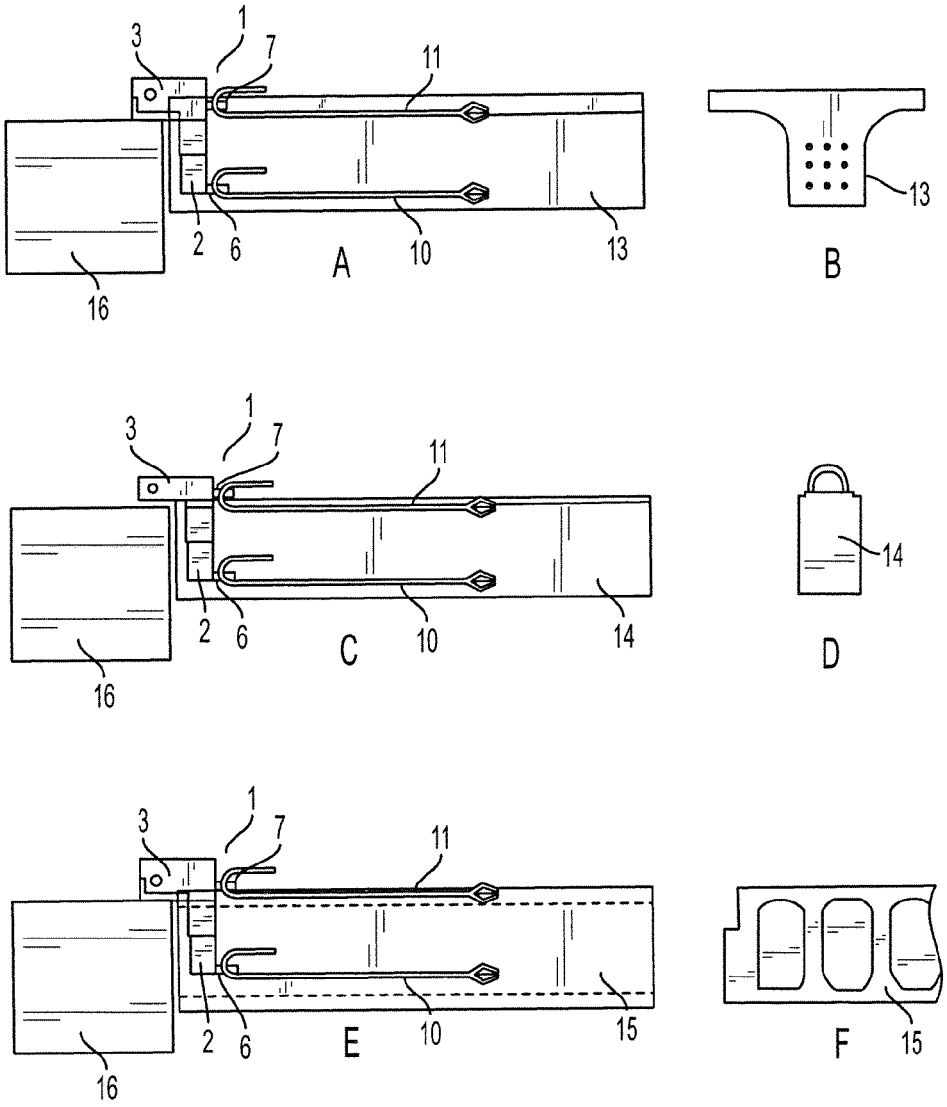
FIGS. 7A-F shows sectional side and end views of the preferred embodiment of the present invention shown in FIG. 3 cast into a 'double tee' concrete flooring unit (A,B), 'rib-and-infill' concrete flooring unit (C,D) and hollowcore concrete flooring unit (E,F)
Figure 8:
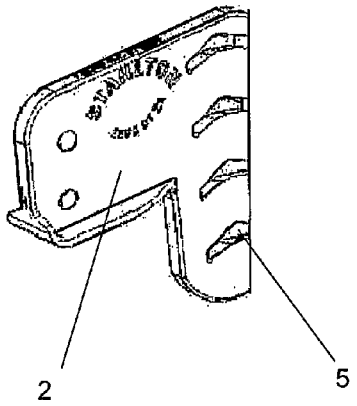
FIGS. 8A-D shows a series of method steps 1 to 4 followed in the construction of a concrete floor using the preferred embodiment of the present invention shown in FIG. 3.
Figure 8:
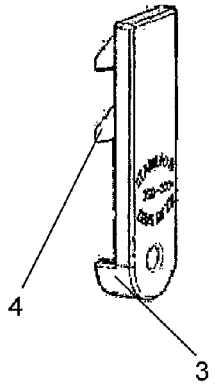
Figure 8:
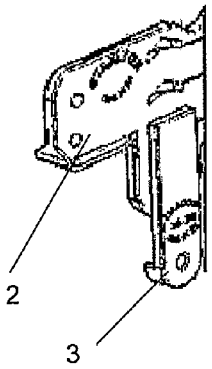
Figure 8:
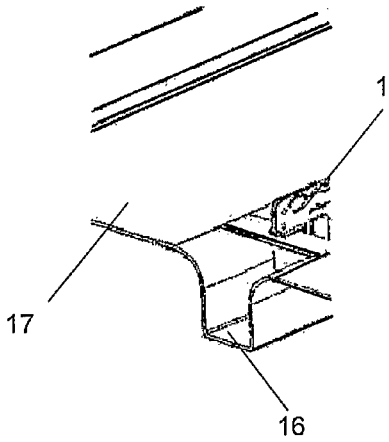
Figure 9:
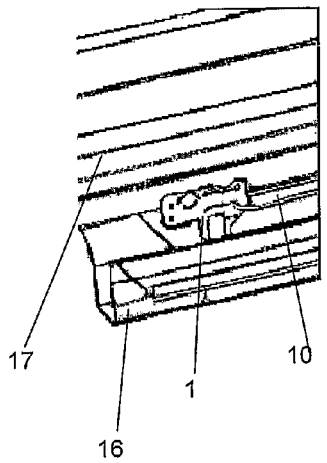
FIGS. 9A-D shows a series of method steps 5 to 8 followed in the construction of a concrete floor using the preferred embodiment of the present invention shown in FIG. 3.
Figure 9:
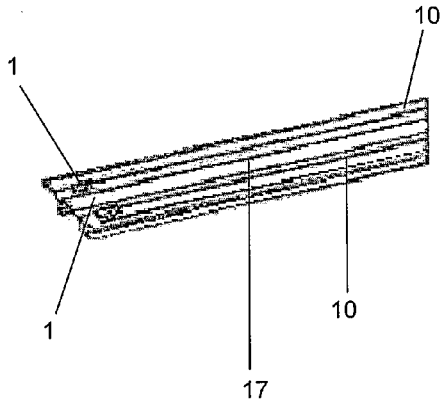
Figure 9:
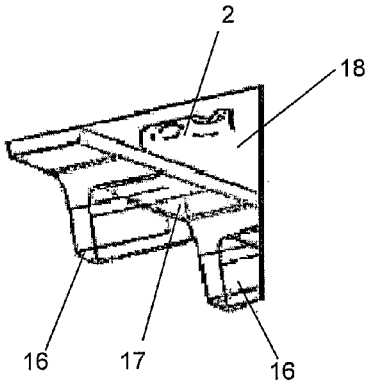
Figure 9:
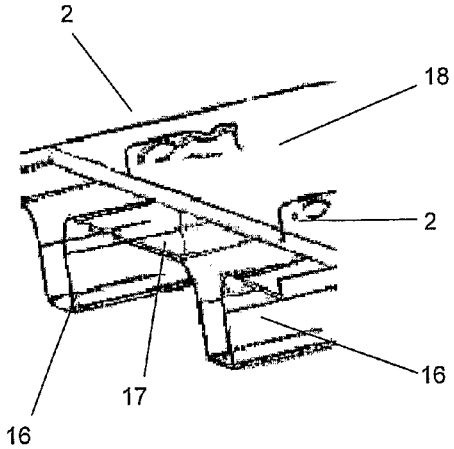
Figure 10:
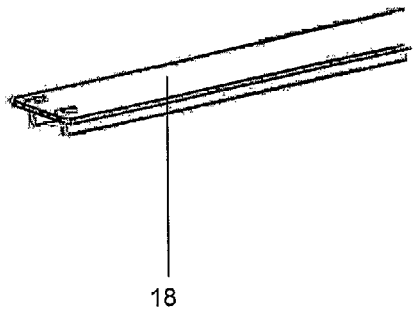
FIGS. 10A-D shows a series of method steps 9 to 12 followed in the construction of a concrete floor using the preferred embodiment of the present invention shown in FIG. 3.
Figure 10:
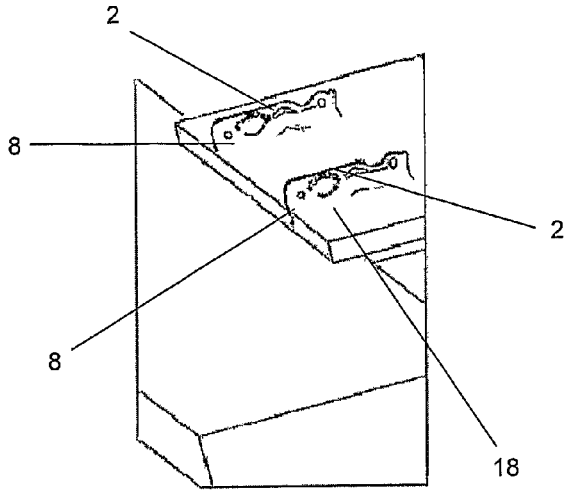
Figure 10:
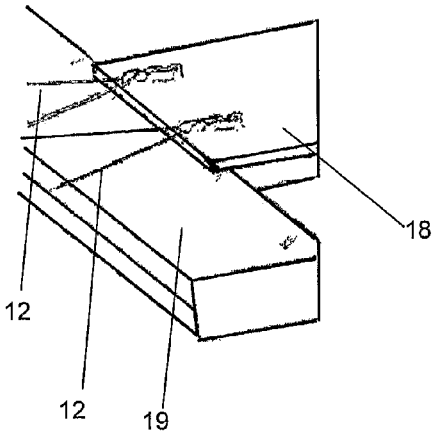
Figure 10:
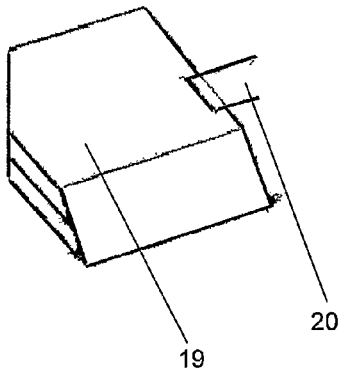

FIG. 6 shows the hanger system of the present invention generally indicated by arrow 1. When the first 2 and second 3 hanger components are interlocked with each other the seats 6 and 7 form parallel arms for attachment of upper 11 and/or lower 10 tension ties for anchorage to a concrete flooring unit (not shown). A further tension tie 12 is connected through aperture 8A of the hanger system 1 following lifting of the flooring unit into place in known fashion. This tie is used for anchorage to a post-cast topping concrete to provide increased resistance to building movements such as those caused by seismic activity.

FIGS. 7A to 7F show sectional and end views of the hanger system 1 cast into a concrete flooring unit in the form of a 'double tee' concrete unit 13(A, B), 'rib-and-infill' concrete unit 14(C,D) and hollowcore concrete unit 15(E,F). The two tension ties 10, 11 attached to seats 6, 7 of hanger components 2,3 respectively anchor the hanger system 1 into the concrete flooring unit (13, 14, 15).

The upper portion of the second hanger component 3 forms a support surface of the cast in hanger system 1 and concrete flooring unit (13, 14, 15) to be hung off a building support beam 16 such as an I-beam or concrete wall.

A range of sizes of the first hanger component (2) and second hanger component (3) is needed to accommodate manufacture of building units (13) of different depth for different applications. For example, double tee building units (13) are commonly required in depths from 200 to 600 mm (in 50 mm increments). This size range necessitates two sizes of first hanger component (2) and three different sizes of second hanger component (3). Different combinations and different heights of adjustment of the first hanger component (2) relative to the second hanger component (3) results in production of building units with eighteen different depths (assuming three second interlocking portions (5)). Similar principles apply to production of hollow core building units (15) of a depth range of 150 mm to 400 mm in 100 mm increments and production of rib and infill building units (14) of a depth range of 100 mm to 300 mm in 25 mm increments.

The adjustability of the hanger system 1 enables a range of hanger heights to be obtained from a relatively small number of components which obviates the need for a manufacturer of concrete pre-cast building units to stock a large number different hanger size and profile combinations for different applications.

Referring to FIGS. 8A to 10D the hanger system 1 may used in a method of production of a cementitious building unit. A person skilled in the art will appreciate from the description ensuring that other configurations or moulds suitable for the production of rib and infill (14) and hollow core (15) building units may be used without departing from the scope of the present invention (as shown in FIG. 8D). The production method comprises the steps:

1. obtaining a first hanger component (2) (as shown in FIG. 8A);
2. obtaining a second hanger component (3) (as shown in FIG. 8B);
3. interlocking the first interlocking portions (4) of the first hanger component (2) with the second interlocking portions (5) of the second hanger component (3) to form a hanger system (1) of the required vertical height for a double tee concrete building unit (13) of the pre-determined depth (as shown in FIG. 8C);
4. locating an interlocked hanger system (1) at both ends of both channels (16) of a double tee mould (17). A lifting eye (8) is positioned proximal to the top of the first hanger component (2) so that it later can be used for positioning of a formed cementitious building unit after casting;
5. attaching a tension tie (10) to seat (6) of the first hanger component (2) and/or a tension tie (11) to the seat (7) of the second hanger component (3); repeating this procedure for each hanger system (1) in each of the channels (16) (as shown in FIGS. 9A and 9B);
6. casting the interlocked hanger systems (1) in the double tee mould (17) either in a production facility or on the building site so that the lifting eye (8) of each hanger system (1) remains exposed to form a precast flooring unit (18) (as shown in FIG. 9C);
7. removing the mould (17) (in known fashion) either in the production facility or on the building site to form a precast flooring unit (18) (as shown in FIG. 10A);
8. attaching a lifting hook (not shown) through the lifting eye (8) of each hanger system (1) at each corner of the precast flooring unit (18) for positioning (after transport from the site of production to a building site) in relation to a building support surface (19) with lifting eye (8) on the first hanger component (2). In this way ease of installation is improved as secondary operations such as welding of a separate lifting eye onto the pre-cast building unit (13, 14, 15) is obviated (as shown in FIG. 10B); and
9. attaching at least one second tension tie (12) to the cast in first hanger component (2) for anchorage to a post-cast cementitious topping portion (20) (as shown in FIGS. 10C and 10D). Positioning of the lifting eye (8) proximal to the building support surface minimises cracking of the post-cast topping portion and provides extra support in the case of loss of seat on the building support surface (e.g. in a seismic event).

Thus, preferred embodiments of the present invention have a number of advantages over the prior art which can include:

- improved flexibility: by altering the dimensions of the hanger to suit 'double tee', 'rib-and-infill' and hollowcore concrete building units and to provide multiple combinations of hanger for different applications and different heights. The invention obviates the need to stock all different hanger size and profile combinations;
- a decrease in floor height by enabling hanging of a concrete hollowcore building unit rather than placement on top of a building structural support;
- reduced cost of manufacture compared to known concrete hanger systems;
- improved ease of production of concrete building units of different heights relative to a supporting structural beam which enables reduction of floor heights of between 100 and 600 mm floor depth;
- improved ease of installation as the system of the present invention does not rely on welding any components together;
- improved durability compared to known concrete hanger systems; and
- improved resistance of concrete floors to earth movements such as seismic activity by virtue of tying the precast concrete building unit to the topping concrete of the supporting beam.

Aspects of the present invention have been described by way of example only and it should be appreciated that modifications and additions may be made thereto without departing from the scope thereof as defined in the appended claims.

What we claim is:

1. A hanger for a cementitious building unit, said hanger comprising:

a first hanger component comprising a body having a first front surface and a plurality of first interlocking portions protruding from said first front surface and arranged in predetermined positions on the body of the first hanger component;

a second hanger component comprising a body having a second front surface and a plurality of second interlocking portions being openings in said second front surface and arranged in predetermined positions on the body of the second hanger component; and an overhanging portion that transversely extends from the body of the second hanger component and is configured for being seated on and directly abutting a building support surface, wherein the first interlocking portions each engage a corresponding one of said openings in said second front surface such that said first front surface and said second front surface are in contact with each other and said first interlocking portions and said second interlocking portions have close-fitting, complementary shapes to each other such that at least two of said first interlocking portions matingly engage with corresponding ones of said second interlocking portions to provide for vertical height adjustment of the first hanger component relative to the second hanger component; and wherein the first hanger component also comprises at least one first connecting portion having an opening for accommodating a tension tie for anchorage within the cementitious building unit.

2. The hanger for a cementitious building unit as claimed in claim 1, wherein the second hanger component also comprises at least one first connecting portion for a tension tie for increased anchorage within the cementitious building unit.

3. The hanger for a cementitious building unit as claimed in claim 1, wherein at least one of the first hanger component and the second hanger component also comprises at least one second connecting portion for a tension tie for anchorage within a post-cast topping cementitious portion.

4. The hanger for a cementitious building unit as claimed in claim 3, wherein the at least one second connecting portion for a tension tie is positioned proximal to the overhanging portion.

5. The hanger for a cementitious building unit as claimed in claim 1, wherein the second interlocking portions include corresponding recesses.

6. The hanger for a cementitious building unit as claimed in claim 1, wherein at least one of the first hanger component and the second hanger component also comprises at least one aperture adapted to function as a lifting eye and an attachment point for a second tension tie.

7. The hanger for a cementitious building unit as claimed in claim 1, wherein the first hanger component and second hanger component are made from galvanised steel.

8. A hanger for a cementitious building unit, said hanger comprising:

a first hanger component comprising a first body having a first front surface, a plurality of first interlocking portions protruding from said first front surface and arranged in predetermined positions on said first body and a first seat laterally extending from said first body;

a second hanger component comprising a second body having a second front surface, a plurality of second interlocking apertures in the second front surface and arranged in predetermined positions on said second body and a second seat laterally extending from said second body, each of said first and second seats including an opening for accommodating a tension tie for anchorage within the cementitious building unit; and an overhanging portion that laterally transversely extends from the second body of the second hanger component and is configured for being seated on and directly abutting a building support surface, wherein the first interlocking portions each engage a corresponding one of said apertures in said second front surface such that said first front surface and said second front surface are in contact with each other and said first interlocking portions and said second interlocking portions have close-fitting, complementary shapes to each other such that at least two of said first interlocking portions matingly engage with corresponding ones of said second interlocking portions to provide for vertical height adjustment of the first hanger component relative to the second hanger component.

* * * * *